US011844159B2

(12) United States Patent
Beij et al.

(10) Patent No.: US 11,844,159 B2
(45) Date of Patent: Dec. 12, 2023

(54) DRIVER FOR DRIVING A LOAD, AS WELL AS A CORRESPONDING LED BASED LIGHTING DEVICE AND A CORRESPONDING METHOD OF OPERATING THE DRIVER

(71) Applicant: SIGNIFY HOLDING B.V., Eindhoven (NL)

(72) Inventors: Marcel Beij, Sint Oedenrode (NL); Frits Tobi De Jongh, Beek en Donk (NL); Hermanus Johannes Maria Vos, Waalre (NL); Henricus Mathijs Maria Creemers, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/907,896

(22) PCT Filed: Feb. 23, 2021

(86) PCT No.: PCT/EP2021/054394
§ 371 (c)(1),
(2) Date: Aug. 29, 2022

(87) PCT Pub. No.: WO2021/175650
PCT Pub. Date: Sep. 10, 2021

(65) Prior Publication Data

US 2023/0146236 A1 May 11, 2023

(30) Foreign Application Priority Data

Mar. 3, 2020 (EP) ..... 20160716

(51) Int. Cl.
*H05B 45/3725* (2020.01)
*H05B 45/34* (2020.01)

(52) U.S. Cl.
CPC ..... *H05B 45/3725* (2020.01); *H05B 45/34* (2020.01)

(58) Field of Classification Search
CPC ..... H05B 45/3725; H05B 45/37–385; H05B 45/34–345
See application file for complete search history.

(56) References Cited

U.S. PATENT DOCUMENTS

2010/0213759 A1 8/2010 Covaro
2012/0249014 A1 10/2012 Mei
(Continued)

FOREIGN PATENT DOCUMENTS

EP 2490509 A2 8/2012
WO 2012126895 A2 9/2012

*Primary Examiner* — Renan Luque

(57) ABSTRACT

A driver for driving a load, the driver comprising a power converter for converting an input to an output for powering the load, a controller for controlling the output of the power converter by controlling a control voltage on a communication line provided in between the power converter and the controller, wherein the controller is arranged to control the control voltage to be within a predetermined control voltage range, wherein the power converter is further arranged for communicating from the power converter to the controller by controlling the control voltage on the communication line to be outside of the predetermined control voltage range.

14 Claims, 4 Drawing Sheets

(56) References Cited

U.S. PATENT DOCUMENTS

| | | | | |
|---|---|---|---|---|
| 2012/0256540 | A1 | 10/2012 | Batty et al. | |
| 2016/0226393 | A1 | 8/2016 | Haas et al. | |
| 2017/0223791 | A1* | 8/2017 | Fukuda | H05B 45/20 |
| 2018/0029526 | A1 | 2/2018 | Matsui et al. | |
| 2019/0242534 | A1* | 8/2019 | Xiong | H05K 3/363 |
| 2019/0342971 | A1 | 11/2019 | Zou | |

* cited by examiner

DRIVER FOR DRIVING A LOAD, AS WELL AS A CORRESPONDING LED BASED LIGHTING DEVICE AND A CORRESPONDING METHOD OF OPERATING THE DRIVER

CROSS-REFERENCE TO PRIOR APPLICATIONS

This application is the U.S. National Phase application under 35 U.S.C. § 371 of International Application No. PCT/EP2021/054394, filed on Feb. 23, 2021, which claims the benefit of European Patent Application No. 20160716.5, filed on Mar. 3, 2020. These applications are hereby incorporated by reference herein.

BACKGROUND

Typically, drivers are arranged for converting a mains voltage into a voltage and current suitable to drive a particular load, for example a load consisting of one or more Light Emitting Diodes, LEDs. These drivers may be equipped with switched mode power supply control Integrated Circuits, IC's, utilizing buck converters or anything alike.

The amount of power converted by the driver may be set by an external control signal, for example in a pulse width modulated or in an analog manner. The external control signal may be referred to as power conversion information content. Power conversion information content may be contained in the "high/low" ratio of the repetitive, e.g. 1 kHz Pulse Width Modulation, PWM, signal. The power conversion information content may be contained in the analog signal in the absolute amplitude voltage.

In any case, in a driver in accordance with the present disclosure, three separated building blocks may be recognized. A first building block is the power converter. The power converter may thus receive a mains supply voltage and may be arranged for converting the mains supply voltage to a certain power output that is suitable for driving a load. The load is identified as the second building block. The third building block is the controller itself. The controller thus controls the power conversion by directly controlling the power converter. Often, these building blocks are physically separated. The present disclosure is especially suitable for situations in which the controller is physically separated from the power converter.

In some cases, for example for safety reasons, the controller may need to receive information from the power converter about, for example, the mains input voltage or anything alike. Unfortunately, the above mentioned power control information is "communicated" using one-way only communication, i.e. only from the controller to the power converter. The power converter is, typically, a simple analog module with no communication possibilities. Adding intelligent building blocks for, for example, two-way communication will not only increase costs but also complexity.

There is thus a need for improving currently available drivers in that they are able to communicate from the power converter back to the controller in a non-complex manner.

SUMMARY

It would be advantageous to achieve a driver that is able to communicate from the power converter back to the controller in a non-complex manner.

It would also be desirable to achieve a Light Emitting Diode, LED, based lighting device comprising the improved driver.

It is further desirable to provide a method of operating the improved driver.

To better address one or more of these concerns, in a first aspect, there is provided a driver for driving a load, the driver comprising:

- a power converter for converting an input to an output for powering the load;
- a controller for controlling the output of the power converter by controlling a control voltage on a communication line provided in between the power converter and the controller, wherein the controller is arranged to control the control voltage to be within a predetermined control voltage range;

wherein the power converter is further arranged for communicating from the power converter to the controller by controlling the control voltage of the communication line to be outside of the predetermined control voltage range.

The inventors have found that, typically, a communication line is present between the controller and the power converter for conveying the control voltage from the controller to the power converter. The voltage, more specifically the electric potential, at this communication line is typically within a predetermined control voltage range, for example between 600 mV and 1600 mV.

The control voltage may take any voltage in between the 600 mV and the 1600 mV in case the control voltage is an analog voltage. In case of a PWM signal, the signal may be alternatively be switched between a high voltage level threshold, being for example the, or close to the, 1600 mV, and a low voltage level threshold, being for example the, or close to the, 600 mV, with a certain duty cycle.

In any case, the inventors have found that there might be unallocated voltages/unallocated voltage ranges available to be utilized by the power converter for communicating back to the controller. That is, for example, the power converter may either pull the control voltage on the communication line to below the low voltage level threshold or may push the control voltage on the communication line to above the high voltage level threshold. In such a way, the power converter may communicate back to the controller.

The power converter may be connected to an Alternating Current, AC, mains supply, or may be connected to any other suitable power source. Different types of power converts exist, each of which suitable to be used in the driver according to the present disclosure. For example, a half-wave rectification rectifier only allows the positive part of the AC supply voltage to pass while blocking the negative part of the AC supply voltage. This is typically accomplished using a single diode.

In another example, a full wave rectification rectifier converts the whole of the AC supply voltage to one of constant polarity at its output. The positive part of the AC supply voltage is allowed to pass, and the negative part of the AC supply voltage is converted to a positive part. This may be accomplished using a bridge rectifier, or by using two diodes in combination with switches.

Typically, the power converter comprises a switched mode power supply for providing the output power to the load. The switched mode power supply has an Integrated Circuit, IC, which may be considered the brains of the switched mode power supply. The IC controls a switch, for example a Field Effect Transistor, wherein the switching rate of the switch determines the output of the power converter.

The communication line, more specifically the control voltage present on the communication line, may be used as an input to the IC for controlling the output of the converter.

As mentioned before, the control voltage present on the communication line may be a PWM voltage signal, wherein the PWM voltage signal alternates between a high level threshold and a low level threshold with a particular duty cycle. Such a PWM voltage signal may be filtered, smoothed, or anything alike, at the power converter before it is provided to the IC.

As mentioned above, the control voltage signal present on the communication line may also be an analog voltage signal, wherein the analog voltage signal is controlled to be within the predetermined control voltage range, for example between a high level threshold and a low level threshold. Such an analog voltage signal may be filtered, or anything alike, at the power converter before it is provided to the IC.

The controller may be powered by a Direct Current, DC, power source that is outputted by the power converter, or may be powered in any other manner. In any case, the controller is arranged to control, or set, the desired output power to the load. The controller may comprise, for example, a potentiometer for setting the desired output power. The controller may also comprise a wireless communication module arranged for receiving a particular set point for the output power to the load, wherein the controller is arranged for converting the received set point to a control voltage on the communication line.

The wireless communication module may, for example, be arranged to communicate via Wi-Fi, via Bluetooth or using any other known communication technology.

Further, the wireless communication module may also be arranged to transmit, i.e. communicate, itself. For example, the information received from the power converter over the communication line may be communicated to the outside world.

The controller may comprise any type of hardware such as a microprocessor, a micro controller, a Field Programmable Gate Array, FPGA, or anything alike. The controller may be empowered via power converter, or may be empowered using an auxiliary power supply such as a battery.

In an example, the driver comprises the communication line, and the controller comprises a control impedance connected to the communication line, and is arranged for controlling the control impedance for controlling the control voltage to be within said predetermined control voltage range.

In a further example, the power converter comprises a communicator impedance connected to the communication line, and is arranged for controlling the communicator impedance for controlling the control voltage to be outside of the predetermined control voltage range.

The above described examples are directed to a voltage divider. A voltage divider is a circuit that is arranged to produce an output voltage that is a fraction of its input voltage. The communication line may, for example, be connected to a supply voltage via the control impedance, and may be connected to ground via the communicator impedance.

The control voltage, i.e. the voltage present on the communication line may then be set by amending any of the control impedance and the communicator impedance. Typically, the control impedance is amended, by the controller, for controlling the power converter. The communicator impedance, however, is amended, by the power converter, in case the power converter intends to communicate back to the controller. The communicator impedance may effectuate that the control voltage present on the communication line is out of the predetermined control voltage range.

In a further example, the control impedance comprises a first control impedance connected to the communication line and connected to a supply voltage, and comprises a switch connected in series with a second control impedance, wherein the switch and the second control impedance are placed in parallel over the first control impedance, and wherein the controller is arranged for controlling the switch for controlling the control impedance.

Following the above, the controller is arranged to control the output impedance, i.e. the control impedance, to two options. In a first option, the control impedance equals the first control impedance. In a second option, the control impedance equals the first control impedance cascaded in parallel with the second control impedance.

In another example, the power converter comprises a communicator switch placed in parallel over the communicator impedance, wherein the power converter is arranged for controlling the switch for controlling the control voltage to be outside of the predetermined control voltage range.

In one of the aspects of the present disclosure, the power converter comprises a communicator impedance and a communicator switch placed in series with the communicator impedance, wherein the communicator impedance or the communicator switch is connected to the communication line, and wherein the power converter is arranged for controlling the switch for controlling the control voltage to be outside of the predetermined control voltage range.

In a further example, the controller is arranged for reading out the control voltage on the communication line provided in between the power converter and the controller.

In a second aspect of the present disclosure, there is provided a Light Emitting Diode, LED, based lighting device, comprising:

at least one LED for emitting light;

a driver in accordance with any of the examples provided above, wherein the driver is arranged for driving the load being the at least one LED.

It is noted that the advantages and definitions as disclosed with respect to the embodiments of the first aspect of the invention, being the driver, also correspond to the embodiments of the second aspect of the invention, being the LED based lighting device, respectively.

In an example, the LED based lighting device comprises an LED board having said at least one LED, and wherein said power converter is placed at a first end of said LED based lighting device, and wherein said controller is placed at a second end of said LED based lighting device, said second end being opposite to said first end, and wherein said LED board is placed in between said power converter and said LED board.

In a further example, the LED based lighting device is an LED tube.

The driver in accordance with the present disclosure may be used in a retrofit Light Emitting Diode, LED, lamp. LED lighting devices have been developed, in the past, that make use of LEDs for a variety of lighting applications. Owing to their long lifetime and high energy efficiency, LED lamps are nowadays also designed for replacing traditional fluorescent lamps, i.e. for retrofit applications. For such an application, a retrofit LED lamp is typically adapted to fit into the socket of the respective lamp fixture to be retrofitted. Moreover, since the maintenance of a lamp is typically conducted by a user, the retrofit LED lamp should ideally be readily operational with any type of suitable fixture without the need for re-wiring the fixture.

In accordance with the present disclosure, the retrofit LED lamp may be any of a retrofit LED tube or a retrofit LED photoluminescence lamp. A retrofit LED tube is a replacement LED tube for a fluorescent tube which is, for example, a low pressure mercury-vapour gas-discharge lamp that uses fluorescence to produce visible light.

Typically, ballasts are used in conventional fluorescent lamps to limit the current through the lamp, which could otherwise rise to destructive levels due to the negative differential resistance artefact in the tube's voltage-current characteristic. Different types of ballasts exist, for example an electronic ballast, a High Frequency electronic ballast, a self-oscillating HF ballast, a magnetic ballast or a digital ballast.

The power converter in accordance with the present disclosure may thus be connected to such a ballast, and may be arranged to convert the output of the ballast to an output suitable to drive at least one LED of the retrofit LED lamp.

In a third aspect of the present disclosure, there is provided a method of operating a driver in accordance with any of the examples provided above, wherein the method comprises the steps of:

controlling, by the controller, the output of the power converter by controlling the control voltage on the communication line provided in between the power converter and the controller to be within a predetermined control voltage range;

communicating, by the power converter, by controlling the control voltage of the communication line to be outside of the predetermined control voltage.

These and other aspects of the invention will be apparent from and elucidated with reference to the embodiment(s) described hereinafter.

DETAILED DESCRIPTION

A detailed description of the drawings and figures are presented. It is noted that a same reference number in different figures indicates a similar component or a same function of various components.

Figure 1:
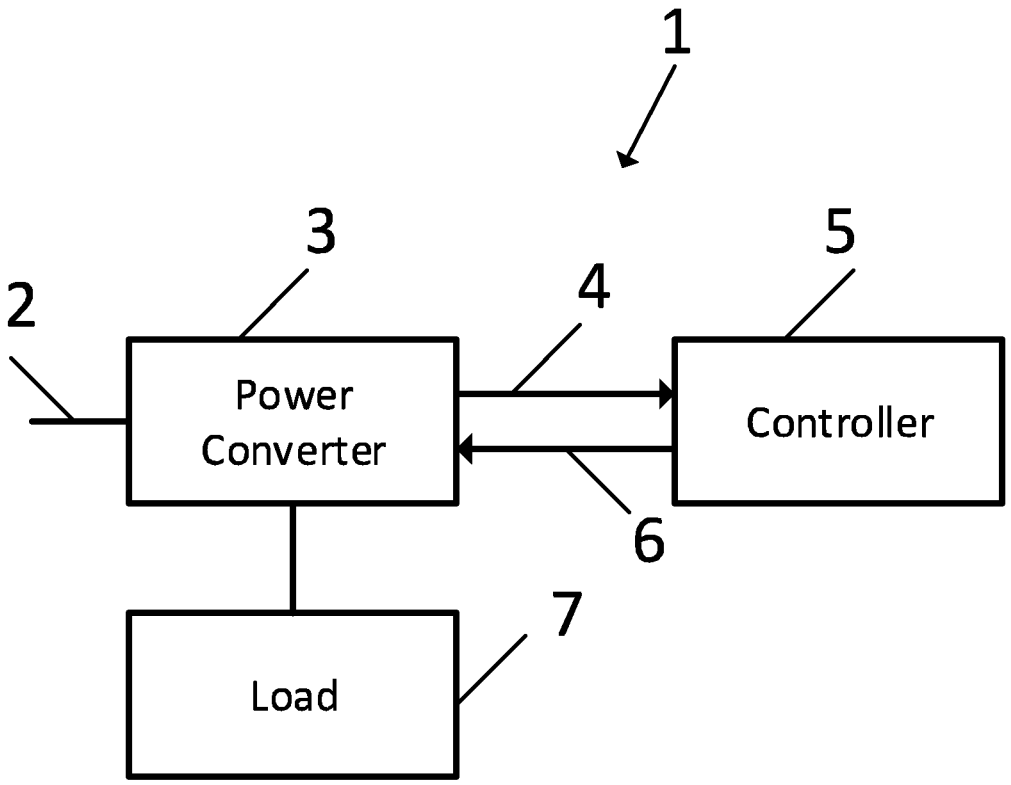
FIG. 1 discloses a schematic diagram of a driver which is driving a particular load.

FIG. 1 shows a schematic diagram of a driver 1 which is driving a particular load 7, for example a Light Emitting Diode, LED, based load.

A power converter 3 is provided for converting an input 2 to an output for powering the load 7. The power converter may receive the input 2 from an Alternating Current, AC, mains supply, from any type of ballast or alike. The power converter 3 converts the input to the output based on power control information 6 received from a controller 5.

In the following, it is assumed that the load is an LED based load. However, it is noted, that the present disclosure is not limited to LED based loads. The concept may be applicable to any kind of load.

The power control information 6 may, for example, be directed to a particular dimming level of the LED load. Typically, the power control information 6 is in a predetermined control voltage range, wherein, at a low voltage threshold of the range a high dimming factor is obtained and wherein, at a high voltage threshold of the range, a low dimming factor is obtained.

The power control information 6 may further be an analog signal or may be a Pulse Width Modulated, PWM, signal. In case of a PWM signal, the signal alternates between the low voltage threshold of the range and the high voltage threshold of the range, wherein the duty cycle of the PWM signal provides for the desired dimming level that is to be obtained.

Finally, a supply line 4 is provided between the power converter 3 and the controller for voltage reference purposes.

Figure 2:
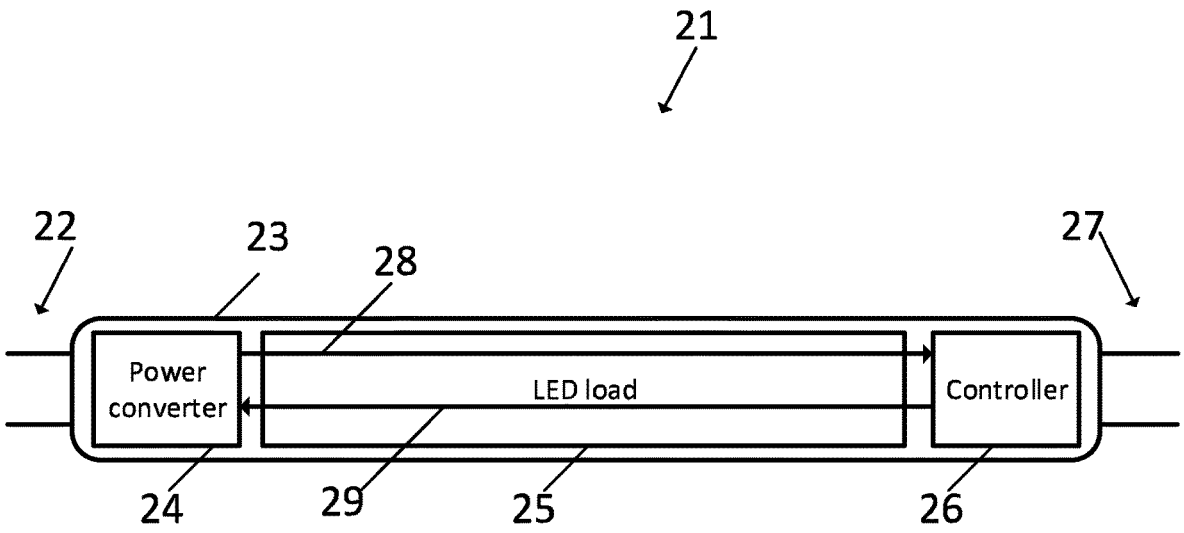
FIG. 2 discloses a schematic diagram of a retrofit Light Emitting Diode, LED, based lighting device in accordance with the present disclosure.

FIG. 2 discloses a schematic diagram of a retrofit Light Emitting Diode, LED, based lighting device 21 in accordance with the present disclosure.

It is noted that the driver in accordance with the present disclosure is especially suitable for retrofit LED based lighting devices. A retrofit LED based lighting device is a device which is adapted to fit into the socket of the respective lamp fixture to be retrofitted. Typically, the retrofit LED based lighting device is designed to replace traditional fluorescent lamps like a fluorescent tube. As such, the connectors 22, 27 of the retrofit LED tube may be placed on the same location and may have the same dimensions as the connectors of the lamp it retrofits.

FIG. 2 is directed to a retrofit LED based lighting tube 21, i.e. a lighting device having an elongated shape. The retrofit LED based lighting tube 21 comprises a housing 23, which housing comprises the power converter 24, the LED load 25 and the controller 26.

The power converter 24 is, typically, located at a first end of the LED based lighting tube 21, and the controller is, typically, located at a second end, opposite to the first end, of the LED based lighting tube 21. The LED load 25 is located in between the power converter 24 and the controller 26. The LED load 25 itself also has an elongated shape. The power converter 24 and the controller 26 are thus physically separated.

The length of the LED based lighting tube 21, i.e. in elongated direction, may be between 20 cm-120 cm, and, more preferably, between 40 cm and 80 cm. The tube may have a circular cross section, wherein the diameter of the cross section may be between 10 mm-50 mm, preferably between 20 mm-30 mm.

It is foreseeable that in certain situations, for example for safety reasons, the controller 26 may need to receive information from the power converter 24. Such information may, be directed to the mains input voltage. The controller 26 may use that information to improve the power control information that is sent to the power converter 24.

The communication line 29 between the controller 26 and the power converter 24 is, in accordance with the present disclosure, utilized in two manners. The communication line 29 is used for conveying the power control information from the controller 26 to the power converter 24. Such power control information is conveyed in the form of a control voltage, wherein the control voltage is controlled, by the controller, to be within a predetermined control voltage range. For example between 600 mV and 1600 mV.

The present disclosure is directed to the concept that the power converter 24 is also able to communicate back to the controller 26. In order to do so, the power converter 24 is arranged to control the control voltage present on the communication line to be outside of the predetermined control voltage range. That is, the power converter overrides the control voltage that is set on the communication line 29.

The power converter may, for example, connect the communication line 25 directly to ground such that the control voltage present on the communication line 29 is 0V. Another option is that the power converter assures that the communication line 25 becomes floating. Both options are addressed with respect to FIGS. 3 and 4.

It is noted that the protocol used for communicating from the power converter 24 to the controller may be based on existing, known, protocol. For example, the DALI protocol may be suitable. The power converter 24 and the controller 26 may thus have an open, or standardized, interface between them. This allows for exchangeability of controllers and power converters.

Figure 3:
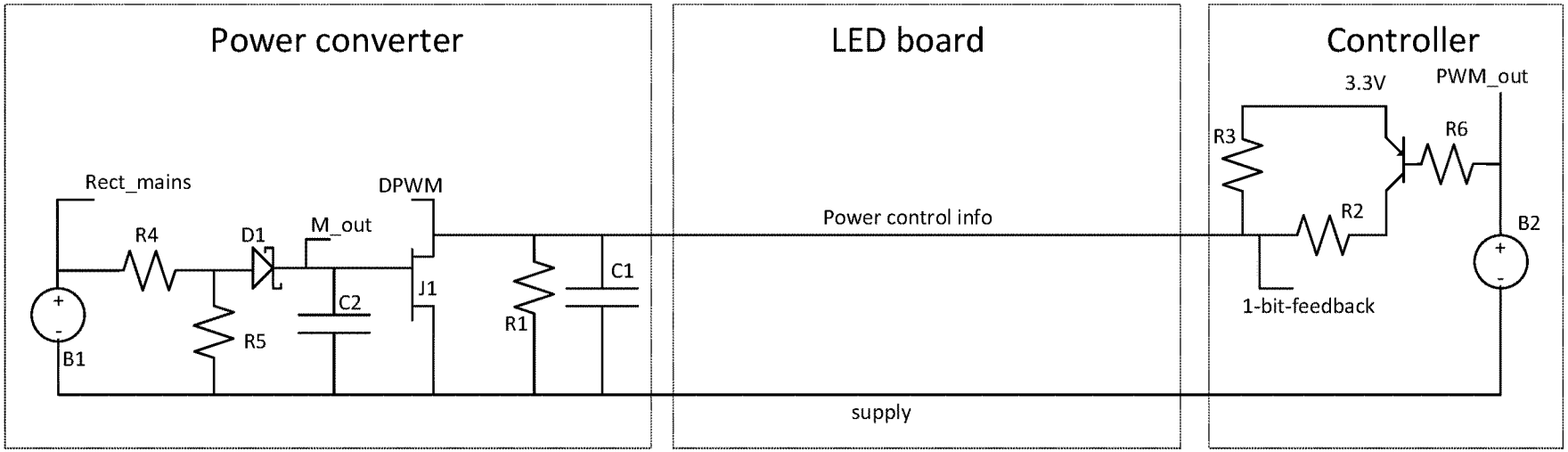
FIG. 3 discloses an example of an implementation of a driver in accordance with the present disclosure.
Figure 4:
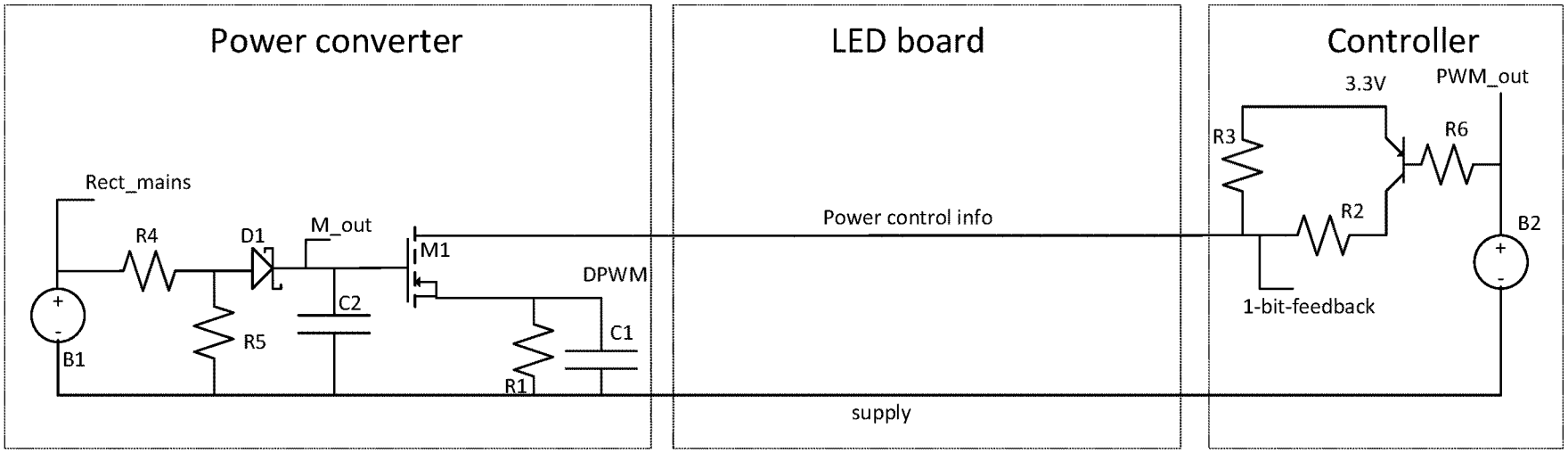
FIG. 4 discloses a further example of an implementation of a driver in accordance with the present disclosure.

FIGS. 3 and 4 disclose examples of implementations of a driver in accordance with the present disclosure.

It is noted that both implementations are directed to a controlled impedance output of the controller that enables a third level on the communication line that can be controlled by the power converter to communicate back to the controller.

FIG. 3 is directed to a first implementation. Here, the controller may be arranged to generate a PWM signal, i.e. PWM_out, which controls the resistor R2, R3 and R1 resistor divider network.

A "low" signal at PWM_out will bring the transistor of the controller into the conducting state and will place R2 in parallel over R3 thereby bringing the voltage at Digital PWM, i.e. DPWM, to a "high" state.

A "high" signal at PWM_out and an applied supply voltage of 3.3V will lead to the state in which the transistor of the controller is non-conducting. As such, the divider network consists of the resistor R3 and the resistor R1, thereby bringing the voltage at Digital PWM, i.e. DPWM, to a "low" state.

By controlling the duty cycle of the PWM_out signal, the output of the power converter may be controlled.

The circuit around switch J1 of the power converter is arranged to control the switch J1. When, for example, the mains voltage drops this will be indicated at the resistor divider R4/R5 turning the switch J1 from the blocking state into the normal conducting state lowering the voltage at DPWM to ground.

Due to the fact that the 1-bit-feedback signal is at the same level as the DPWM signal this 1-bit-feedback signal will also be set to ground which can be sensed by the controller. That is, the controller is arranged to sense that the control voltage on the communication line is outside the predetermined control voltage range.

This particular implementation is thus directed to a situation in which a drop in the mains supply voltage is communication from the power converter to the controller. It is noted that any type of information may be communicated from the power converter to the controller.

It is noted that this particular example is directed to communicate information with respect to the mains supply voltage back to the controller. Other information may be communicated as well, for example over heating of any of the elements of the power converter, or malfunctioning of any of the elements of the power converter, or anything alike.

Further, the communication may consist of a 1-bit communication as shown in FIGS. 3 and 4, but may also encompass other types of communication principles. The non-utilized voltage range may be used in an analog manner for conveying information back to the controller. Another option is that the 1-bit communication may be used as some sort of Morse code for conveying the information.

The implementation shown in FIG. 4 may be explained as follows. The controller aspects of the implementation shown in FIG. 4 are, in principle, equal to the controller aspects of the implementation shown in FIG. 3.

The main difference between the implementation shown in FIG. 3 and the implementation shown in FIG. 3 is in the power converter. More specifically, it is directed to the manner in which the power converter controls the control voltage to outside the predetermined control voltage range.

In FIG. 3, the switch J1 is arranged to shortcut the resistor R1 such that the control voltage at the communication line equals the supply voltage. In FIG. 3, the switch M1 is typically switched on such that the resistor R1 is directly connected to the communication line. In case the power converter intends to communicate back to the controller, it may deactivate the switch M1 such that the communication line becomes floating. The control voltage on the communication line will then be equal to the 3.3V of the controller, which is also outside the predetermined control voltage range.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A driver for driving a load, the driver comprising:

a power converter for converting an input to an output for powering the load; and a controller for controlling the output of the power converter by controlling a control voltage on a communication line provided in between the power converter and the controller, wherein the controller is arranged to control the control voltage to be within a predetermined control voltage range;

wherein the power converter is further arranged for communicating from the power converter to the controller by overriding the control voltage on the communication line to be outside of the predetermined control voltage range;

wherein the driver comprises the communication line, and wherein:

the controller comprises a control impedance connected to the communication line, and is arranged for controlling the control impedance for controlling the control voltage to be within said predetermined control voltage range.

2. The driver in accordance with claim 1, wherein the driver comprises the communication line, and wherein:

the control impedance comprises a first control impedance connected to the communication line and connected to a supply voltage, and comprises a switch connected in series with a second control impedance, wherein the switch and the second control impedance are placed in parallel over the first control impedance, and wherein the controller is arranged for controlling the switch for controlling the control impedance.

3. The driver in accordance with claim 1, wherein the controller is arranged for reading out the control voltage on the communication line provided in between the power converter and the controller.

4. A Light Emitting Diode (LED) based lighting device, comprising:

at least one LED for emitting light; and the driver in accordance with claim 1, wherein the driver is arranged for driving the load being the at least one LED.

5. The LED based lighting device in accordance with claim 4, wherein said LED based lighting device comprises an LED board having said at least one LED, and wherein said power converter is placed at a first end of said LED based lighting device, and wherein said controller is placed at a second end of said LED based lighting device, said second end being opposite to said first end, and wherein said LED board is placed in between said power converter and said LED board.

6. The LED based lighting device in accordance with claim 4, wherein said LED based lighting device is an LED tube.

7. A driver for driving a load, the driver comprising:

a power converter for converting an input to an output for powering the load; and a controller for controlling the output of the power converter by controlling a control voltage on a communication line provided in between the power converter and the controller, wherein the controller is arranged to control the control voltage to be within a predetermined control voltage range;

wherein the power converter is further arranged for communicating from the power converter to the controller by overriding the control voltage on the communication line to be outside of the predetermined control voltage range;

wherein the driver comprises the communication line, and wherein:

the power converter comprises a communicator impedance connected to the communication line, and is arranged for controlling the communicator impedance for controlling the control voltage to be outside of the predetermined control voltage range.

8. The driver in accordance with claim 7, wherein:

the power converter comprises a communicator switch placed in parallel over the communicator impedance, wherein the power converter is arranged for controlling the switch for controlling the control voltage to be outside of the predetermined control voltage range.

9. The driver in accordance with claim 7, wherein:

the power converter comprises a communicator impedance and a communicator switch placed in series with the communicator impedance, wherein the communicator impedance or the communicator switch is connected to the communication line, and wherein the power converter is arranged for controlling the switch for controlling the control voltage to be outside of the predetermined control voltage range.

10. The driver in accordance with claim 7, wherein the controller is arranged for reading out the control voltage on the communication line provided in between the power converter and the controller.

11. A Light Emitting Diode (LED) based lighting device, comprising:

at least one LED for emitting light; and the driver in accordance with claim 7, wherein the driver is arranged for driving the load being the at least one LED.

12. The LED based lighting device in accordance with claim 11, wherein said LED based lighting device comprises an LED board having said at least one LED, and wherein said power converter is placed at a first end of said LED based lighting device, and wherein said controller is placed at a second end of said LED based lighting device, said second end being opposite to said first end, and wherein said LED board is placed in between said power converter and said LED board.

13. The LED based lighting device in accordance with claim 11, wherein said LED based lighting device is an LED tube.

14. A method of operating a driver comprising a power converter for converting an input to an output for powering a load and a controller for controlling the output of the power converter, wherein the method comprises:

controlling, by the controller, the output of the power converter by controlling a control voltage on a communication line provided in between the power converter and the controller to be within a predetermined control voltage range; and communicating, by the power converter, by overriding the control voltage of the communication line to be outside of the predetermined control voltage;

wherein the driver comprises the communication line, and wherein:

the controller comprises a control impedance connected to the communication line, and is arranged for controlling the control impedance for controlling the control voltage to be within said predetermined control voltage range.

* * * * *